US005673893A

United States Patent [19]

Klein

[11] Patent Number: 5,673,893

[45] Date of Patent: Oct. 7, 1997

[54] SELF-ADJUSTING PORTABLE TREE STAND

[76] Inventor: William Scott Klein, 5503 Lake Shore Dr., Knoxville, Tenn. 37920

[21] Appl. No.: 517,267

[22] Filed: Aug. 21, 1995

[51] Int. Cl.[6] ..... F16M 13/00

[52] U.S. Cl. ..... 248/525; 248/526

[58] Field of Search ..... 248/524, 525, 248/526, 528, 529

[56] References Cited

U.S. PATENT DOCUMENTS

| | | | |
|---|---|---|---|
| 892,181 | 6/1908 | Peterson | 248/525 |
| 2,023,340 | 12/1935 | Peskulich | 248/528 X |
| 2,621,878 | 12/1952 | Kruger | 248/528 X |
| 2,650,783 | 9/1953 | Stanley | 248/525 X |
| 2,689,701 | 9/1954 | Whitaker | 248/524 |
| 2,761,641 | 9/1956 | Lubbers | 248/526 X |
| 2,909,344 | 10/1959 | Dutton | 248/525 X |
| 3,058,707 | 10/1962 | Lego | 248/528 X |
| 3,119,586 | 1/1964 | Hoffman | 248/524 |
| 4,130,965 | 12/1978 | Patton et al. | 248/524 X |
| 4,676,471 | 6/1987 | Moore | 248/526 |
| 4,699,347 | 10/1987 | Kuhnley | 248/528 X |
| 5,114,113 | 5/1992 | Krinner | 248/525 |

FOREIGN PATENT DOCUMENTS

| | | | |
|---|---|---|---|
| 64051 | 8/1892 | Germany | 248/525 |

*Primary Examiner*—Leslie A. Braun
*Assistant Examiner*—Willie Berry, Jr.

[57] ABSTRACT

A self-adjusting portable tree stand including a rigid annular base; a rigid canister positioned above and in axial alignment with the base; a plurality of rigid elongated holding members with each holding member having a lower end pivotally coupled to the base and tip end with a plurality of teeth formed thereon to create a jaw and with the jaws positioned above the opening of the canister; a coupling mechanism for coupling the canister to the holding members; and a spring mechanism for urging the jaws open prior to insertion and subsequent to removal of a trunk of the tree that is positioned within the canister in an upright orientation.

6 Claims, 4 Drawing Sheets

FIG 7
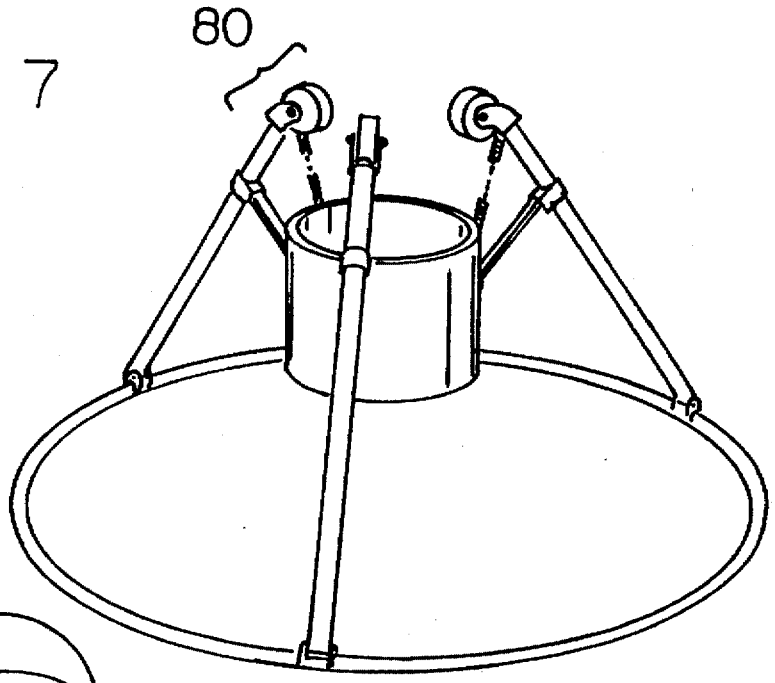
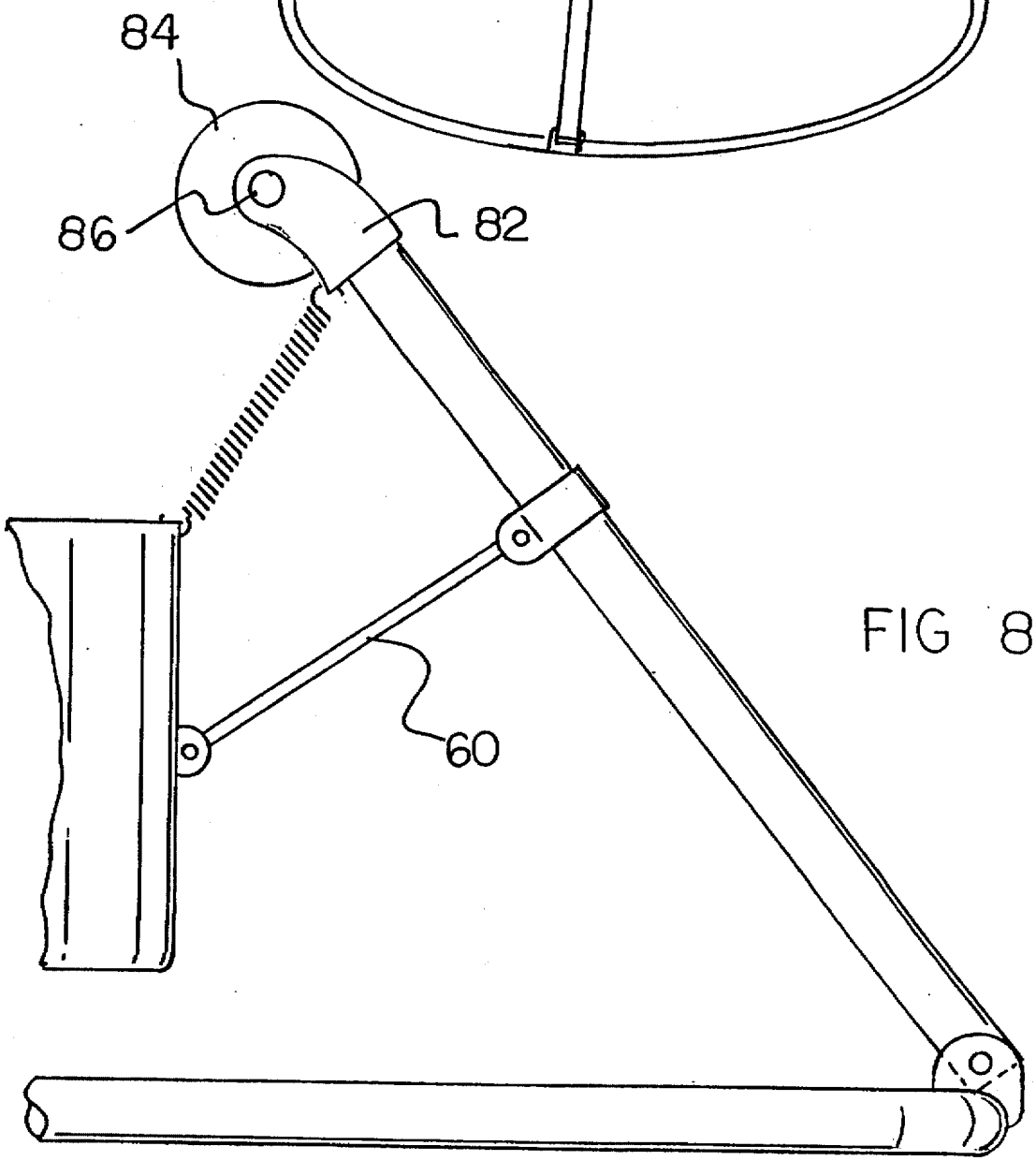
FIG 8

SELF-ADJUSTING PORTABLE TREE STAND

BACKGROUND OF THE INVENTION

1. Field of the Invention

The present invention relates to a self-adjusting portable tree stand and more particularly pertains to holding a tree in an upright orientation with a self-adjusting portable tree stand.

2. Description of the Prior Art

The use of tree stands is known in the prior art. More specifically, tree stands heretofore devised and utilized for the purpose of holding a tree in an upright orientation are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,007,901 to Mancini et al. discloses a Christmas tree stand. U.S. Pat. No. 4,130,965 to Patton et al. discloses a Christmas tree holder. U.S. Pat. No. 4,565,028 to Stephan discloses a Christmas tree stand. U.S. Pat. No. 4,676,471 to Moore discloses a portable stand for a tree. U.S. Pat. No. 4,825,586 to Coppedge discloses a Christmas tree stand. U.S. Pat. No. 4,834,335 to Attar discloses a tree stand.

While these devices fulfill their respective, particular objective and requirements, the aforementioned patents do not describe a self-adjusting portable tree stand that utilizes the weight of a tree to force its spring-loaded jaws closed for holding a tree in an upright orientation.

In this respect, the self-adjusting portable tree stand according to the present invention substantially departs from the conventional concepts and designs of the prior art, and in doing so provides an apparatus primarily developed for the purpose of holding a tree in an upright orientation.

Therefore, it can be appreciated that there exists a continuing need for new and improved self-adjusting portable tree stand which can be used for holding a tree in an upright orientation. In this regard, the present invention substantially fulfills this need.

SUMMARY OF THE INVENTION

In the view of the foregoing disadvantages inherent in the known types of tree stands now present in the prior art, the present invention provides an improved self-adjusting portable tree stand. As such, the general purpose of the present invention, which will be described subsequently in greater detail, is to provide a new and improved self-adjusting portable tree stand and method which has all the advantages of the prior art and none of the disadvantages.

To attain this, the present invention essentially comprises, in combination, a rigid annular base having a fixed diameter. A rigid canister is also included. The canister is positioned above and in axial alignment with the base. The canister has a circular planar bottom wall and a peripheral tubular side wall coupled to and extended upwards from the bottom wall to define an interior space sized for receiving a trunk of the tree and a top opening for allowing access to the space. The canister further has an outer diameter that is less than that of the base. Three upstanding and rigid elongated holding members are included and positioned in a tripod-type arrangement with respect to the base and canister. Each holding member has a beveled lower end pivotally coupled to the base, an inwardly curved tip end, and an intermediate portion therebetween. Each tip end of each holding member further has a plurality of teeth formed thereon to create a jaw. The jaws are positioned above the side wall of the canister. Three links are included and positioned in an inverted tripod-type arrangement with respect to the base and canister. Each link has an inboard end pivotally coupled to the canister and an outboard end pivotally coupled to one of the holding members. Three springs are also provided with each spring having one end coupled to the intermediate portion of one of the members and another end coupled to the side wall of the canister at a location near its opening. The springs urge the jaws open prior to insertion and subsequent to removal of the trunk of the tree that is positioned within the canister in an upright orientation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved self-adjusting portable tree stand which has all the advantages of the prior art tree stands and none of the disadvantages.

It is another object of the present invention to provide a new and improved self-adjusting portable tree stand which may be easily and efficiently manufactured and marketed.

It is a further object of the present invention to provide a new and improved self-adjusting portable tree stand which is of durable and reliable construction.

An even further object of the present invention is to provide a new and improved self-adjusting portable tree stand which is susceptible of a low cost of manufacture with regard to both materials and labor, and which accordingly is then susceptible of low prices of sale to the consuming public, thereby making such a self-adjusting portable tree stand economically available to the buying public.

Still yet another object of the present invention is to provide a new and improved self-adjusting portable tree stand which provides in the apparatuses and methods of the prior art some of the advantages thereof, while simultaneously overcoming some of the disadvantages normally associated therewith.

Even still another object of the present invention is to provide a new and improved self-adjusting portable tree stand for holding a tree in an upright orientation.

Lastly, it is an object of the present invention to provide a new and improved self-adjusting portable tree stand comprising a rigid annular base; a rigid canister positioned above and in axial alignment with the base; a plurality of rigid elongated holding members with each holding member having a lower end pivotally coupled to the base and tip end with a plurality of teeth formed thereon to create a jaw and with the jaws positioned above the opening of the canister; coupling means for coupling the canister to the holding members; spring means for urging the jaws open prior to insertion and subsequent to removal of a trunk of the tree that is positioned within the canister in an upright orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a perspective view of an alternate embodiment of the present invention.

FIG. 8 is an enlarged fragmentary side-elevational view of the alternate embodiment of the present invention.

The same reference numerals refer to the same parts through the various Figures.

DESCRIPTION OF THE PREFERRED EMBODIMENT

Figure 1:
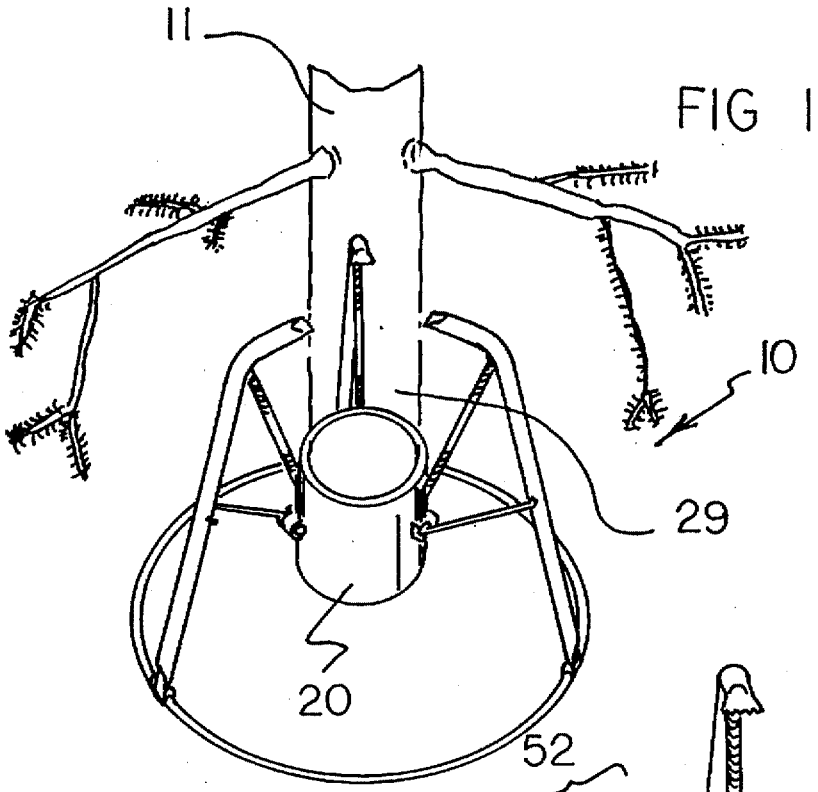
FIG. 1 is a perspective view of the preferred embodiment constructed in accordance with the principles of the present invention for holding a tree in an upright orientation.
Figure 2:
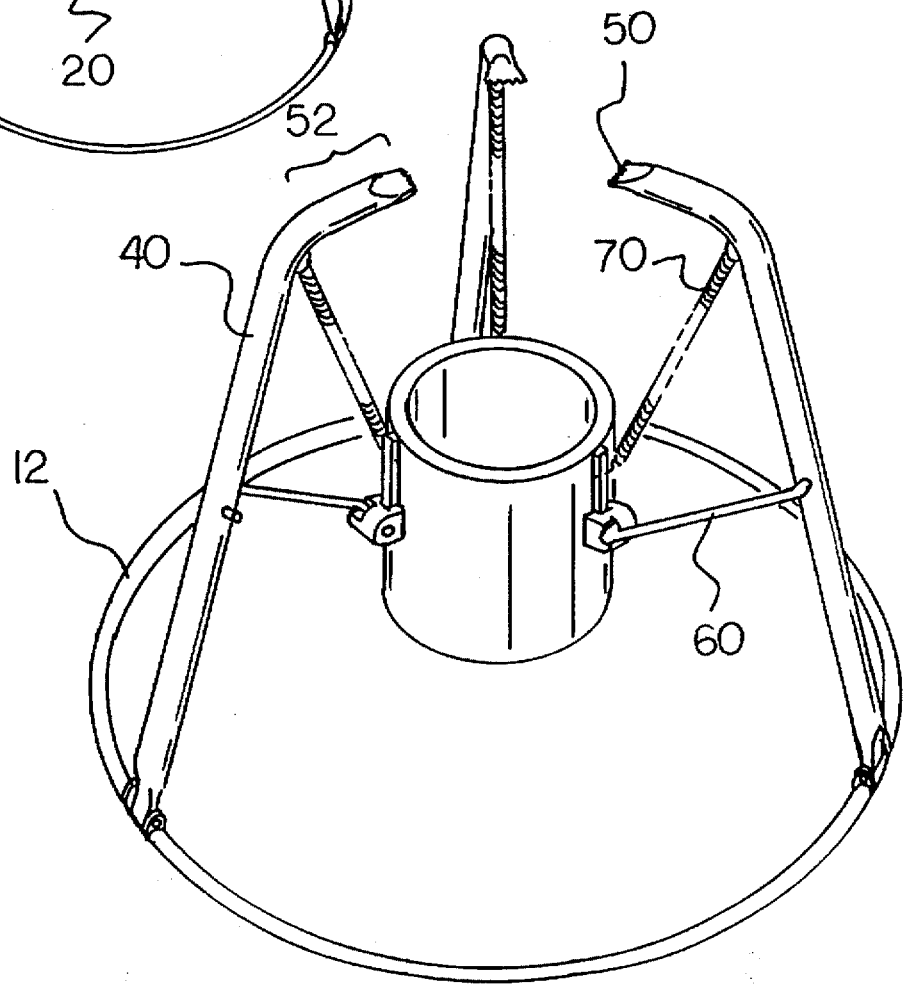
FIG. 2 is another perspective view of the preferred embodiment of the present invention.
Figure 3:
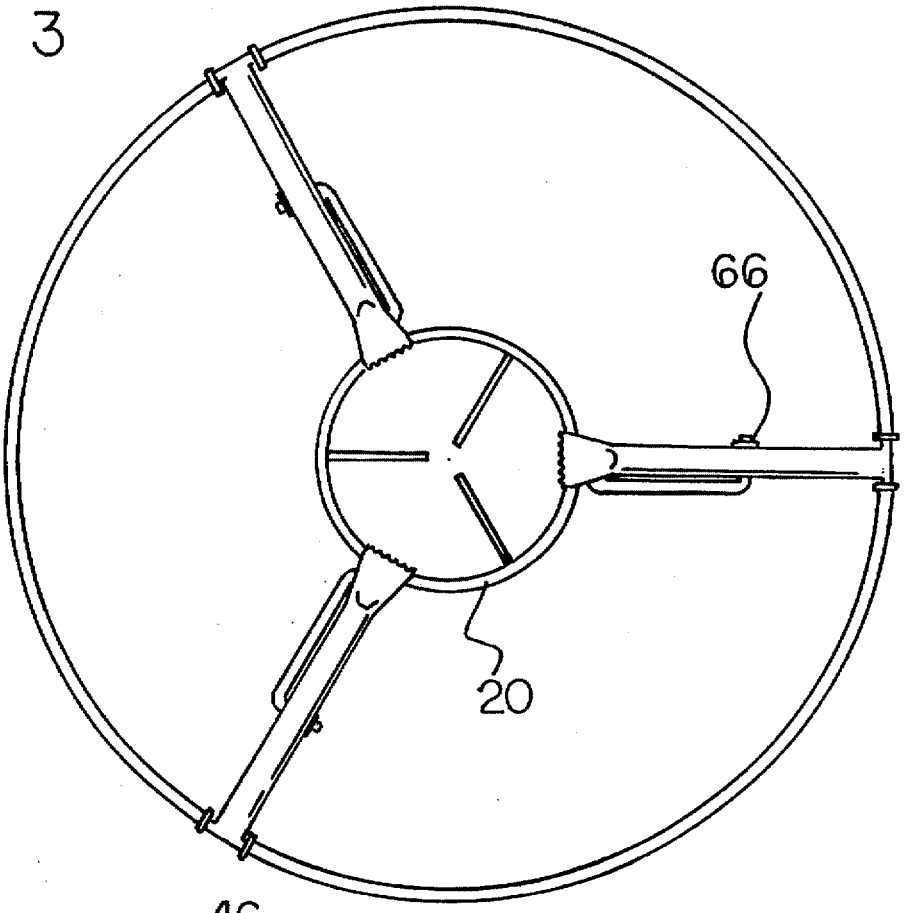
FIG. 3 is a plan view of the preferred embodiment of the present invention.
Figure 4:
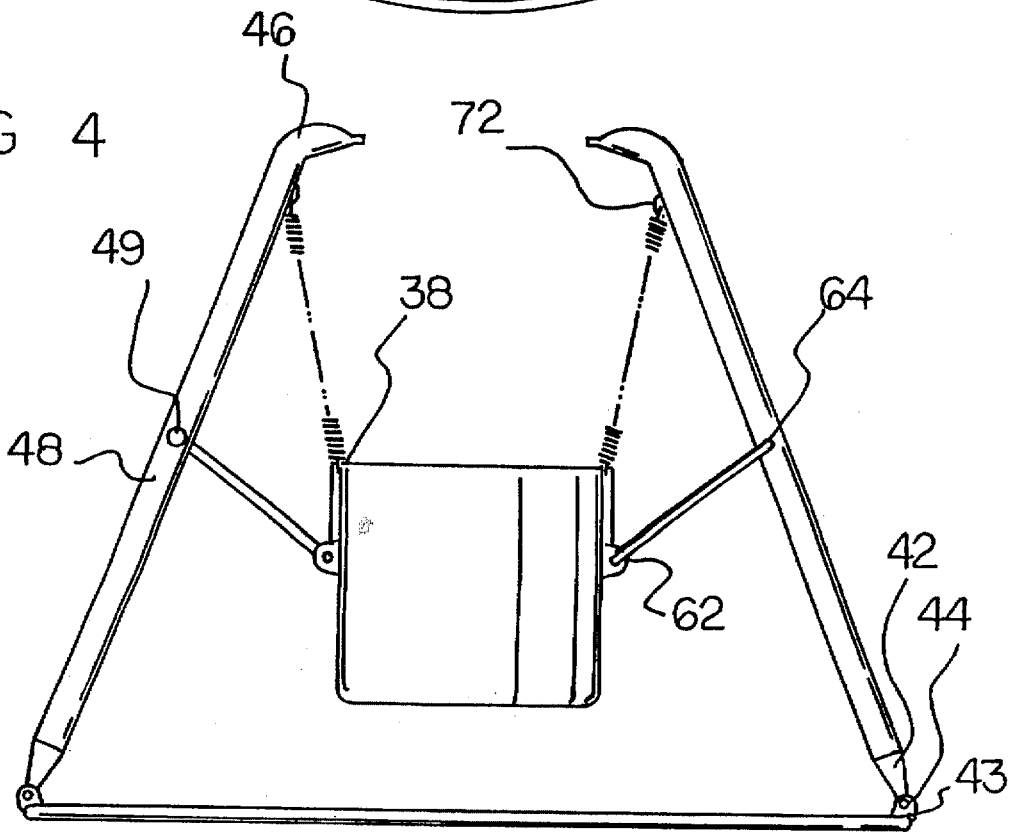
FIG. 4 is a side-elevational view of the preferred embodiment of the present invention.
Figure 5:
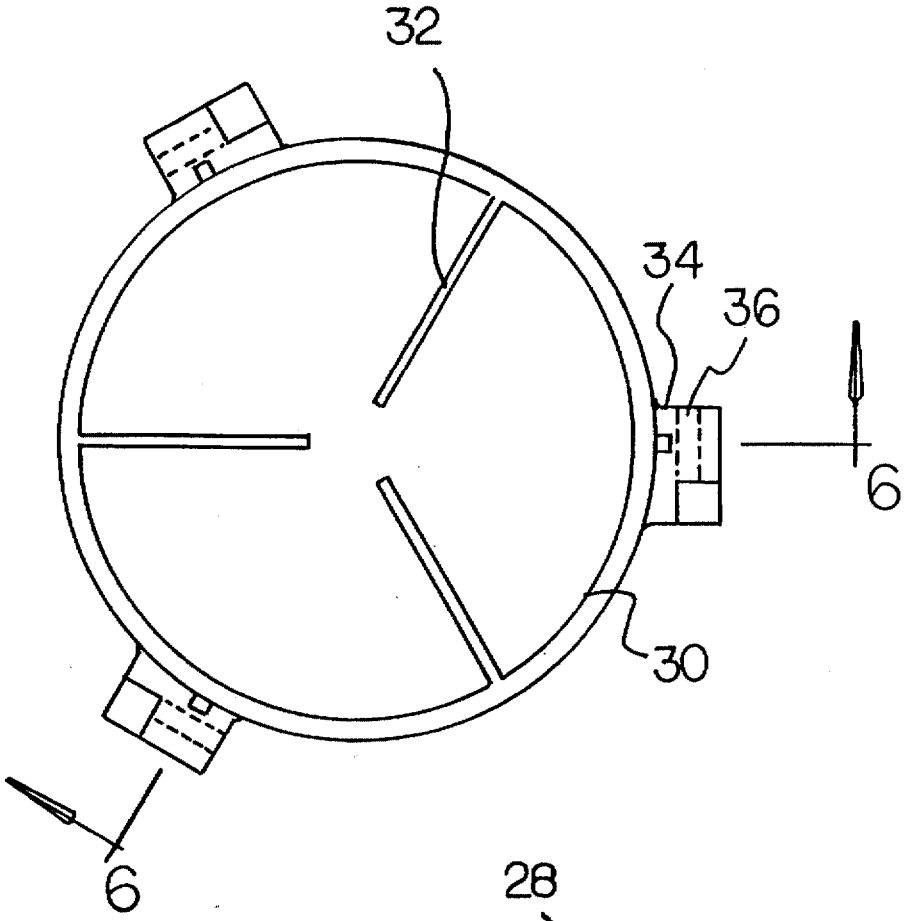
FIG. 5 is an enlarged plan view of the canister of the present invention.
Figure 6:
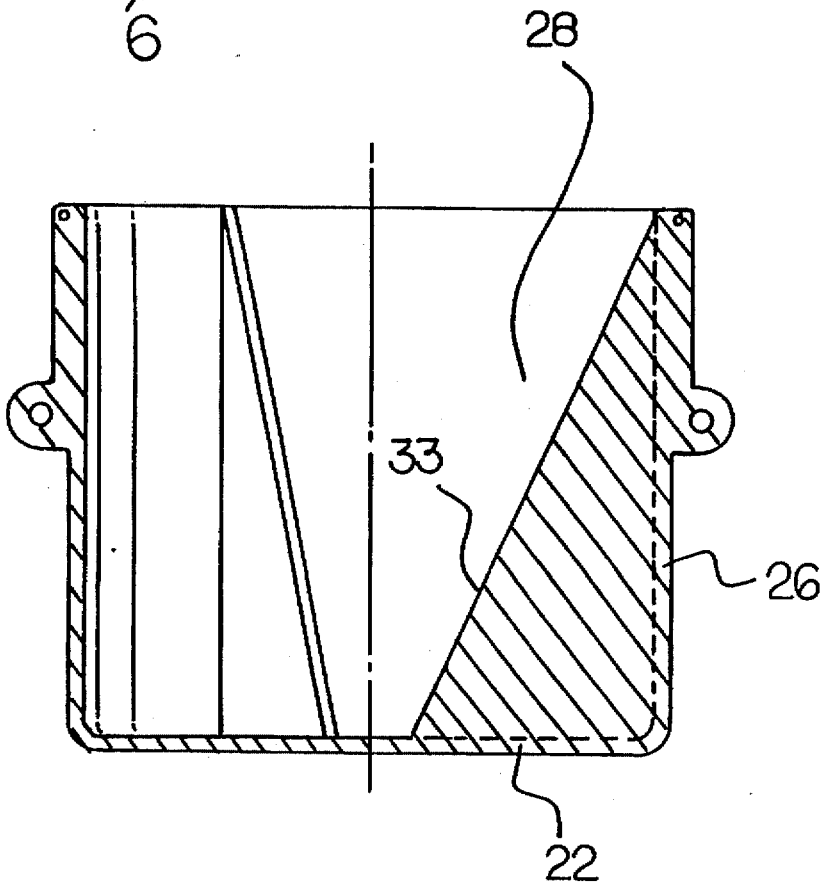
FIG. 6 is a cross-sectional view of the present invention taken along the line 6—6 of FIG. 5.

With reference now to the drawings, and in particular, to FIG. 1 thereof, the preferred embodiment of the new and improved self-adjusting portable tree stand embodying the principles and concepts of the present invention and generally designated by the reference number 10 will be described.

The preferred embodiment of the present invention comprises a plurality of components. In their broadest context, such components include a base, a canister, holding members, links, and springs. Such components are individually configured and correlated with respect to each other to provide the intended function of holding a tree 11 in an upright orientation.

Specifically, the present invention includes a rigid annular base 12. The base has a fixed diameter of about 24 inches and a central axis. The base is formed of a length of ⅜-inch diameter mild steel rod that is formed into a circle with its ends welded together.

Positioned above and in axial alignment with the base 12 is a canister 20. The canister has a central axis, a circular planar bottom wall 22, and a peripheral tubular side wall 26 coupled to and extended upwards from the bottom wall to define an interior space 28 sized for receiving a trunk 29 of a tree and a top opening 30 for allowing access to the space. The canister has an exterior diameter of about 7 inches and an axial length of about 6.5 inches. Disposed within the space 28 of the canister and coupled thereto are three radially extending ribs 32. Each rib is generally triangular in shape and has an upper angled edge 33. Each rib is offset from an adjacently located rib by about 120 degrees. The edge of each rib is positioned at an angle of between about 60–70 degrees with respect to the bottom wall of the canister. The ribs are utilized for engaging a trunk 29 of the tree 11 for holding it in a fixed position. Coupled to the exterior of the canister are three elongated mounting strips 34. Each mounting strip is offset by about 120 degrees from the adjacently located strip. Each mounting strip has a link connecting hole 36 formed therethrough at a lower extent thereof and a spring connecting hole 38 formed therethrough at an upper extent thereof. The canister is formed of a molded rigid plastic of a bright green color. All edges of the canister are rounded or filleted to a radius of 0.0375 inches.

Positioned in a tripod-type arrangement with respect to the base 12 and canister 20 are three upstanding, rigid, and elongated holding members 40. Each holding member has a beveled lower end 42 that is pivotally coupled to the base through the use of a pair of base pivot pieces 43 and a pin 44. Each holding member also has an inwardly curved tip end 46. In addition, each holding member has a straight intermediate portion 48 extended between the lower end 42 and the tip end 46. An angle of between about 65–75 degrees is formed between the tip end 46 and the intermediate portion of each holding member. Each holding member has a length of between about 19 and 20 inches. The intermediate portion has a link connecting hole 49 formed thereon. Each tip end 46 of each holding member also has a plurality of teeth 50 formed thereon to create a jaw 52. The jaws are positioned above the opening 30 of the canister 20. Each holding member is formed of ½ inch I.D. commercial black iron pipe with a minimum yield strength of about 25,000 psi. In addition, both the base and holding members are sanded or wire-brushed for good paint adhesion and surface finish. The base and holding members are then painted with a corrosion-resistant bright green paint.

Three rigid and generally U-shaped links 60 are included and positioned in an inverted tripod-type arrangement with respect to the base 12 and canister 20. Each link has an inboard end 62 disposed within the link connecting hole 36 of the canister 20 and an outboard end 64 disposed within the link connecting hole 49 on one of the holding members 40. The link thereby is pivotally coupled to the canister and the associated holding member. The ends 62, 64 of the links are each secured with a link retainer 66. Each link retainer is of a push-on fastener type requiring a push-on force of 25 lbs. and a removal force of about 400 lbs. The retainer is formed of steel and is zinc plated. Each link is fashioned of ¼ inch diameter cold-rolled commercial steel rod with a 25,000 psi minimum yield strength. Each link is plated with zinc.

Three springs 70 are also included. Each spring has one end disposed within an eyelet 72 formed on an intermediate portion 48 of one of the holding members and another end coupled within the spring connecting hole 38 on the side wall of the canister 20 at a location near its opening. The springs urge the jaws 52 open prior to insertion and subsequent to removal of a tree trunk that is positioned within the canister in an upright orientation. Furthermore, the weight of the tree within the canister forces the canister downwards to thereby pull the jaws closed. Thus, the present invention is entirely self-adjusting in nature and clamps a tree in a secured position. Each spring is formed of 0.041 inch diameter hard drawn spring wire of commercial quality. The spring has a body diameter of 5/32 inch and is formed with 80 coils. The length of the spring is about 4 inches. The ends of the spring are to be formed in a twisted loop. Initial pre-load tension on each spring is specified as 0.366 lbs. Each spring is plated with zinc.

A second embodiment of the present invention is shown in FIGS. 7 and 8 and includes substantially all of the components of the present invention except the jaws are replaced with roller wheels 80. Each roller wheel is formed of a bracket 82, a wheel 84, and an axle 84 coupling the wheel to the bracket. The wheels allow axial adjustment of the tree 11 within the canister and also allow easy removal of the tree.

The present invention utilizes the weight of a tree to generate a closing and clamping force upon the three jaws for holding the trunk of the tree securely and in an upright orientation. The springs apply a contracting force between their mounted ends which thereby cause the jaws to open and force the canister to its upwardmost vertical position prior to insertion and subsequent to removal of a trunk of a tree placed into the holder. The links restrict the effect of the springs so that the jaws are positioned above the side wall of the canister when the stand is unused and in a state of static equilibrium. The links further limit vertical motion of the canister as to maintain proper distance between the canister and jaws. The main feature of the present invention is that it is thus entirely self-adjusting. There is no adjustment mechanism required to clamp the tree in a fixed position. The tree stand is designed to hold trees in a range of trunk diameters from approximately one inch to approximately six inches. The trunk of a tree is not required to be perfectly straight or evenly cut at its bottom as with other tree stands. Furthermore slight irregularities on the trunk are tolerated with the exception that branches on the tree must be trimmed within an area held between the jaws and the opening of the canister. The present invention also features an annular base that holds the stand in a more stable configuration than those stands which use legs positioned in a tripod-type configuration.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A self-adjusting portable tree stand for holding a tree in an upright orientation comprising, in combination:

a rigid annular base having a fixed diameter;

a rigid canister positioned above and in axial alignment with the base, the canister having a circular planar bottom wall and a peripheral tubular side wall coupled to and extended upwards from the bottom wall to define an interior space sized for receiving a trunk of the tree and a top opening for allowing access to the space and with the canister further having an outer diameter that is less than that of the base;

three upstanding rigid elongated holding members positioned in a tripod-type arrangement with respect to the base and canister, each holding member having a beveled lower end pivotally coupled to the base, an inwardly curved tip end, and an intermediate portion therebetween, each tip end of each holding member further having a plurality of teeth formed thereon to create a jaw and with the jaws positioned above the side wall of the canister;

three links positioned in an inverted tripod-type arrangement with respect to the base and canister, each link having an inboard end pivotally coupled to the canister and an outboard end pivotally coupled to one of the holding members; and three springs with each spring having one end coupled the intermediate portion of one of the members and another end coupled to the side wall of the canister at a location near its opening and with the springs urging the jaws open prior to insertion and subsequent to removal of the trunk of the tree that is positioned within the canister in an upright orientation.

2. A self-adjusting portable tree stand comprising:

a rigid annular base;

a rigid canister positioned above and in axial alignment with the base;

a plurality of rigid elongated holding members with each holding member having a lower end pivotally coupled to the base and a tip end with a plurality of teeth formed thereon to create a jaw and with the jaws positioned above the opening of the canister;

coupling means for coupling the canister to the holding members; and spring means coupled to the holding members for urging the jaws open prior to insertion and subsequent to removal of a trunk of the tree that is positioned within the canister in an upright orientation.

3. The self-adjusting portable tree stand as set forth in claim 2 wherein the canister comprises a circular planar bottom wall and a peripheral tubular side wall coupled to and extended upwards from the bottom wall to define an interior space sized for receiving a trunk of the tree and a top opening for allowing access to the space and with the canister further having an outer diameter that is less than that of the base.

4. The self-adjusting portable tree stand as set forth in claim 2 wherein the coupling means comprises a plurality of elongated rigid links with each link having one end pivotally coupled to the canister and another end pivotally coupled to one of the holding members.

5. The self-adjusting portable tree stand as set forth in claim 2 wherein the spring means comprises a plurality of springs and each of the springs having one end coupled between the canister and another end coupled to one of the holding members.

6. A self-adjusting portable tree stand comprising:

a rigid annular base;

a rigid canister positioned above and in axial alignment with the base;

a plurality of rigid elongated holding members with each holding member having a lower end pivotally coupled to the base and a tip end with a roller wheel coupled thereto and with the roller wheels positioned above the opening of the canister;

coupling means for coupling the canister to the holding members; and spring means coupled to the holding members for urging the roller wheels apart prior to insertion and subsequent to removal of a trunk of the tree that is positioned within the canister in an upright orientation.

* * * * *